United States Patent [19]

Hirsch

[11] 3,940,113

[45] Feb. 24, 1976

[54] PORTABLE FENCE

[76] Inventor: William J. Hirsch, 211 Brantwood Road, Eggertsville, N.Y. 14226

[22] Filed: June 16, 1975

[21] Appl. No.: 587,409

[52] U.S. Cl. ..... 256/24; 256/34

[51] Int. Cl.[2] ..... E04H 17/16

[58] Field of Search ..... 256/1, 24, 25, 26, 32, 256/34

[56] References Cited

UNITED STATES PATENTS

| | | | |
|---|---|---|---|
| 700,820 | 5/1902 | Ralston | 256/24 |
| 3,216,432 | 11/1965 | Eddy | 256/24 |

*Primary Examiner*—Kenneth Downey
*Assistant Examiner*—Doris L. Troutman
*Attorney, Agent, or Firm*—Christel & Bean

[57] ABSTRACT

A portable fence comprising a hollow tubular post element, guide discs adjacent opposite ends of the post element, a length of flexible fencing of the open or closed face type wound around the post element between the guides, and a supporting element removably carried in one end of the tubular post and adapted to be driven into the ground or similar surface. The post element is rotatably supported on the supporting element in an upright position, and the fencing is unwound therefrom to a position of use. At least one of the guide discs is removable from the post so that both guides can be located adjacent the lower end of the upright post thereby resembling a standard permanent fence in appearance. For use on hard or otherwise impenetrable surfaces, one or both of the guide discs can be weighted to support the post element in an upright position.

11 Claims, 14 Drawing Figures

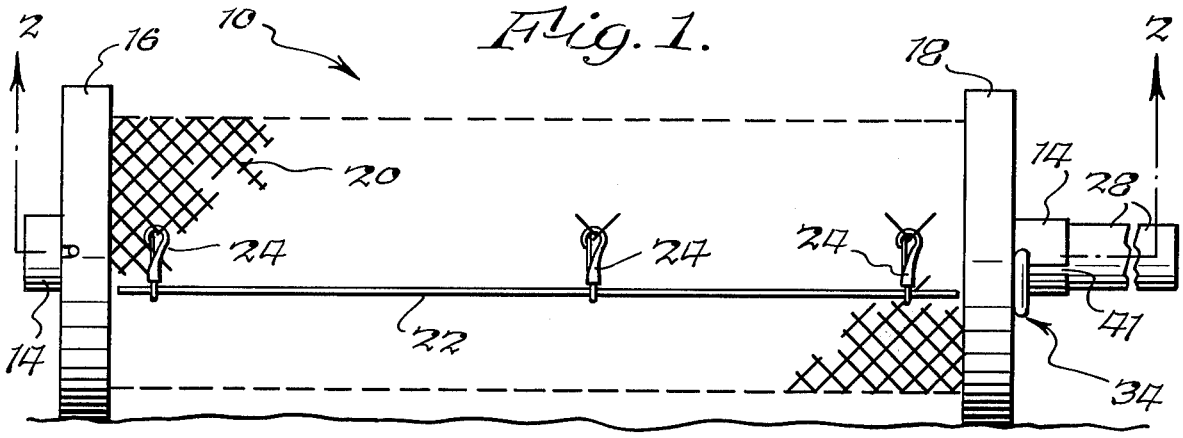
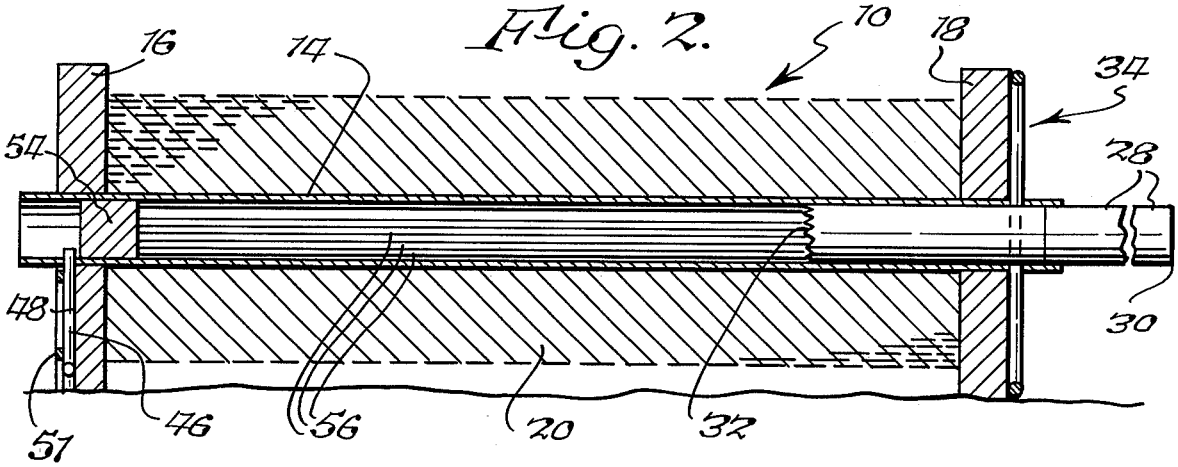
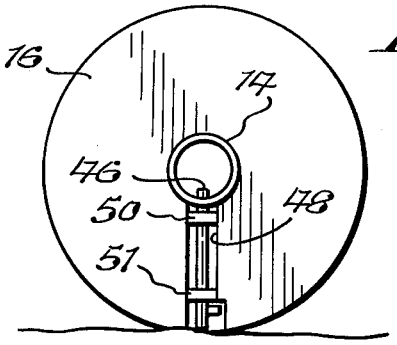
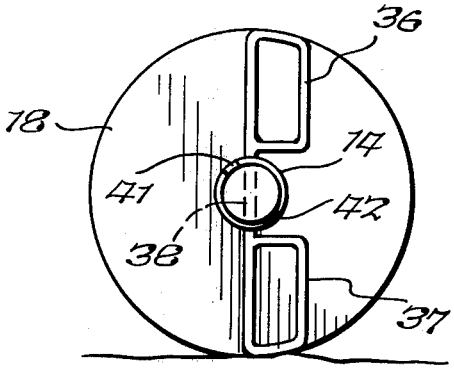
Fig. 4.
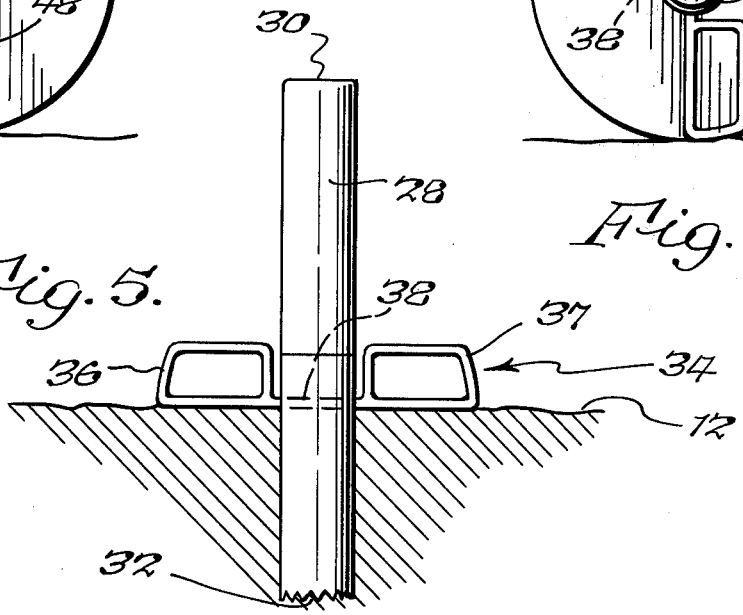
Fig. 5.

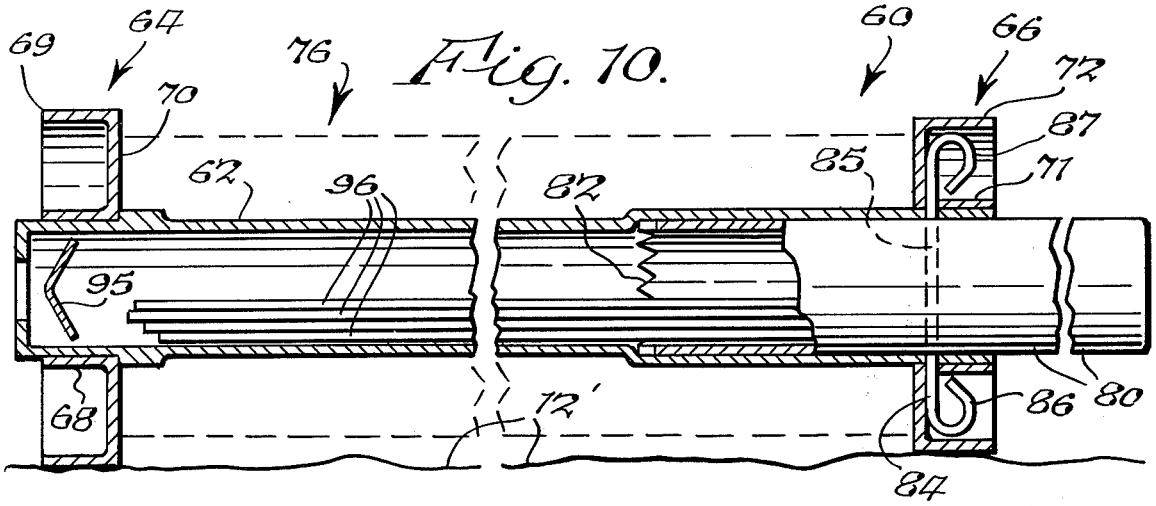
Fig. 10.
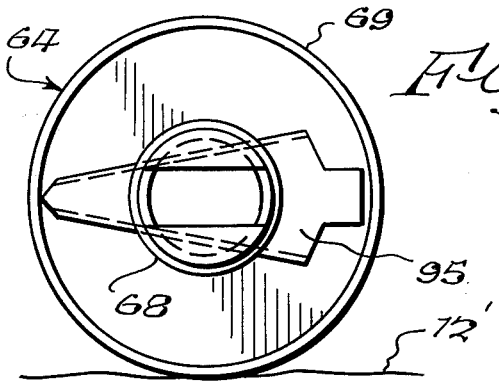
Fig. 11.
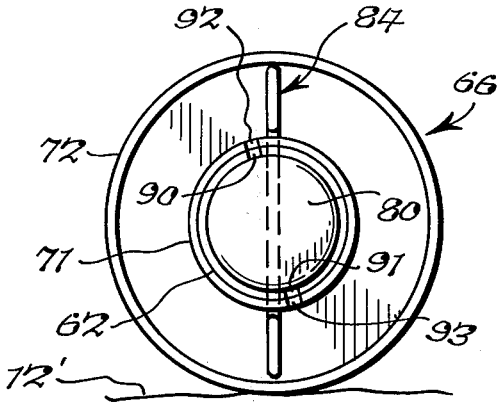
Fig. 12.
Fig. 13.
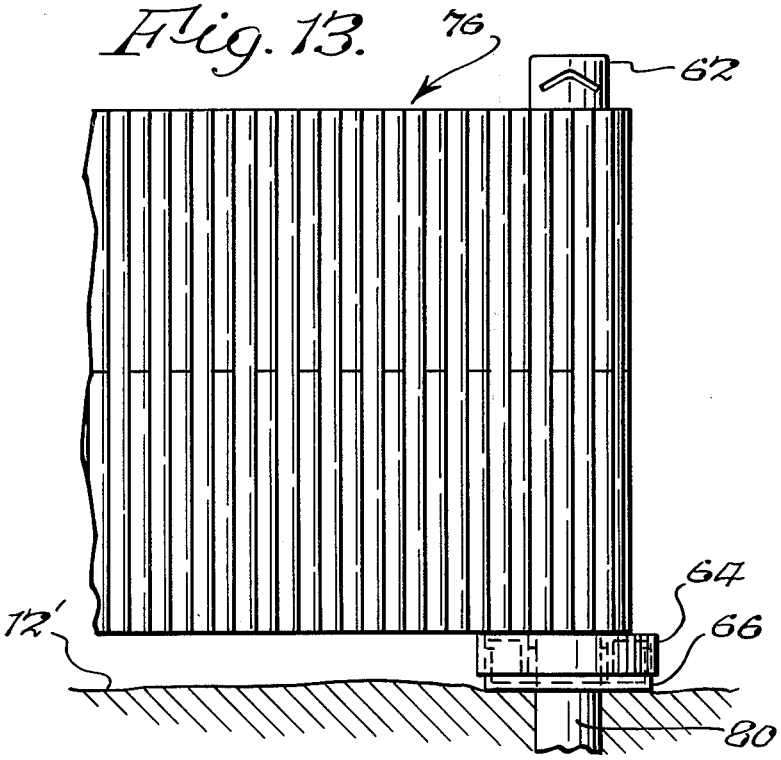
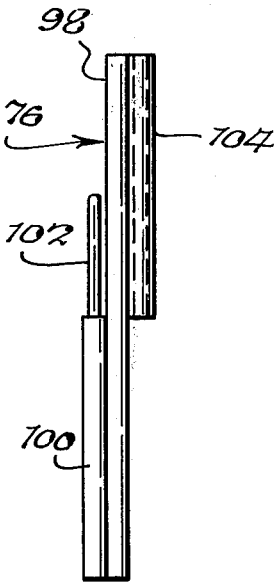
Fig. 14.

PORTABLE FENCE

BACKGROUND OF THE INVENTION

This invention relates to the art of fences, and more particularly to a new and improved portable fence.

It would be highly desirable to provide a reusable, collapsible fence which is capable of easy transportation, erection and removal after temporary use for the protection of persons or property on earthen, sand or hard surfaces. Such a portable fence also should resemble a standard, permanent fence in appearance as much as possible.

SUMMARY OF THE INVENTION

It is, therefore, an object of this invention to provide a new and improved portable fence.

It is a more particular object of this invention to provide a portable fence which is capable of easy transportation, erection, removal and reuse.

It is a more particular object of this invention to provide a portable fence capable of secure installation in use and which is also of relatively compact construction.

It is a more particular object of this invention to provide a portable fence closely resembling a standard, permanent fence in appearance.

It is a further object of this invention to provide such a portable fence which is relatively easy and economical to manufacture.

The present invention provides a portable fence comprising a post element, guide elements adjacent opposite ends of the post element, a length of fencing wound around the post element between the guide elements, and a supporting element removably carried by the fence assembly and adapted to be driven into the ground or similar surface. The post element is rotatably supported on the supporting element in an upright position, and the fencing can be unwound therefrom to a position of use. At least one of the guide elements is removable from the post element so that both guide elements can be located adjacent the lower end of the upright post whereby the arrangement closely resembles a standard permanent fence in appearance. For use on hard or otherwise impenetrable surfaces, one or both of the guide elements can be weighted to support the upright post.

The foregoing and additional advantages and characterizing features of the present invention will become clearly apparent upon a reading of the ensuing detailed description together with the included drawing wherein:

BRIEF DESCRIPTION OF THE DRAWING FIGURES

FIG. 1 is a side elevational view of a portable fence according to the present invention resting on a supporting surface such as the ground with the fencing thereof in a position of storage;

FIG. 2 is a sectional view taken about on line 2—2 in FIG. 1;

FIG. 3 is an end elevational view of the apparatus of FIG. 2 as seen from the left-hand end thereof.

FIG. 4 is an end elevational view of the apparatus of FIG. 2 as seen from the right-hand end thereof;

FIG. 5 is an elevational view of the supporting element of the apparatus of FIGS. 1–4 as it would appear driven into the ground by manual rotation;

FIG. 10 is a sectional view taken about on line 10-10 in FIG. 9;

FIG. 11 is an end elevational view of the apparatus of FIG. 10 as seen from the left-hand end thereof;

FIG. 12 is an end elevational view of the apparatus of FIG. 10 as seen from the right-hand end thereof;

FIG. 13 is a fragmentary elevational view showing the portable fence of FIGS. 9–12 erected in a position of use; and FIG. 14 is an elevational view showing a section of the fencing of the apparatus of FIGS. 9–13.

DETAILED DESCRIPTION OF THE ILLUSTRATED EMBODIMENTS

Figure 6:
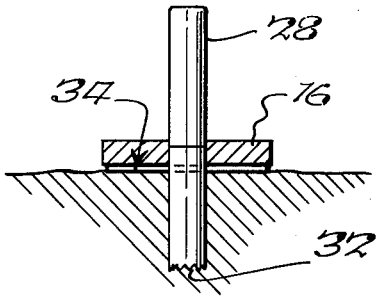
FIG. 6 is an elevational view similar to that of FIGS. 5 but showing a subsequent stage in the installation of the portable fence of the present invention.

Referring now to FIGS. 1–4, a portable fence of the present invention generally designated 10 is shown resting on a supporting surface such as the ground 12 in a position of storage prior to installation and erection. The portable fence 10 comprises storage means including an elongated post element 14 and a pair of guide elements 16, 18 connected to post element 14 at axially spaced locations thereon. In preferred form, post 14 is in the form of a hollow cylinder or tube of suitable metal or plastic, and guide elements 16, 18 are solid, generally discshaped with central openings for receiving tube 14 and of suitable plastic or wood material. The discs 16, 18 are fitted on the hollow tubular core 14 adjacent each end thereof in a manner leaving a small portion of the length of tube 14 projecting outwardly from the exterior surface of the corresponding disc element. Discs 16, 18 define an open region therebetween in an axial direction and in all radial outward directions from post element 14. In other words, there is no enclosure surrounding post element 14 between guide elements 16, 18. Within this region is stored a length of flexible fencing 20 which is fixed at one end to post element 14 and which is wound around the post element in the region between guide elements 16, 18 in a manner similar to winding a length of material on a spool so as to be stored thereon. In particular, the inner end of fencing 20 is fixedly attached or secured by suitable means to post element 14 and the outer end, when fencing 20 is completely wound around post 14, can be releasably secured by means of the arrangement shown in FIG. 1 including a rod element 22 secured to the outer end of fencing 20 and a plurality of clip or hook type fasteners or catches 24 secured to rod 22 which releasably clip or hook to the body of fencing 20 stored around post 14. Other fastening arrangements can of course be employed.

The portable fence of the present invention further comprises supporting elements 28 removably carried by the storage means, the supporting element being elongated and adapted to be driven into the ground or supporting surface adjacent one end thereof and to be operatively connected to the storage means adjacent the other end thereof in a manner supporting post element 14 in a generally vertical position. The connection between supporting element 28 and post element 14 permits rotation of post element 14 relative to supporting element 28 whereby fencing 20 can be withdrawn from the storage means for placement in a position of use with post element 14 supporting the fencing adjacent one end thereof in a manner which will be described in detail presently. In preferred form, post element 28 is a hollow tube or sleeve having a solid closed end 30 and provided with serrations or teeth 32 around the edge defining the opposite open end thereof. Supporting element 28 can be entirely of metal or it can be a combination of metal with wood, plastic or similar material in which case the metal portion of element 28 would include the region at the end thereof including teeth 32. Supporting element 28 is provided with a handle 34 including grip portions 36, 37 extending outwardly from opposite outer surface portions of element 28. Handle 34 can have various forms and can be connected to supporting element 28 in various ways, a preferred arrangement including a central rod-like section 38 which is pivotally or rotatably connected to element 28 through diametrically opposed openings provided in the cylindrical wall thereof. When the apparatus is in a storage condition prior to use, supporting element 28 is fitted into the open end of post 34 with teeth 32 being within tube 14. A pair of diametrically opposed, axially extending slots 41, 42 adjacent the open end of post 14 define a bayonet joint in which the central portion of the handle is lockingly received. During storage of the portable fence 10, handle 34 can be rotated to the position shown in FIGS. 1, 2 and 4 wherein the plane of the grip elements 36, 37 is disposed parallel to the plane of disc 18. Handle 34 can be used for carrying the entire assembly in which case it simply is pivoted or rotated through about an angle of 90° so that one can easily grip the handle portions 36, 37 for carrying.

Guide element 18 preferably is fixedly mounted or secured on support tube 14. Guide element 16 is releasably or removably connected onto the opposite end of support tube 14. One illustrative arrangement for releasably locking disc 16 onto tube 14 includes a slide bolt element 46 adapted for longitudinal movement in a radial slot 48 provided in the exterior surface of disc 16 which bolt 46 is mounted by spaced apart brackets 50, 51 for movement into and out of an opening provided in the wall of tube 14. Other arrangements for releasably locking guide element 16 onto tube 14 can be employed. As shown in FIG. 2, the interior of tube 14 is closed at one end by supporting element 28 and at the other end by a closure element 54 permanently fixed in tube 14 defining therebetween an axial storage region containing a plurality of small diameter rigid rods or posts 56 which are removed from the interior of tube 14 during installation of the fence for supporting the same at spaced locations in a manner which will be described. Stakes 56, being at a length greater than the width of fencing 20, will extend into the hollow interior of supporting element 28.

The portable fence of the present invention is installed in the following manner. The assembly in the condition illustrated in FIG. 1 is taken to the desired location and can be carried conveniently by turning or rotating handle 34 out from the position shown in FIGS. 1 and 2 for grasping or gripping the handle portions 36, 37. In some instances it may be preferable to roll the assembly 10 along the ground to a position of use. Supporting element 28 then is removed from the end of post element 14 simply by grasping the handle portions 36, 37 and rotating element 28 slightly within post 15 to move the central portion 38 along the circumferential portion of the bayonet slot and into axial alignment with slots 41, 42 whereupon supporting element 28 is axially withdrawn from the end of tube 14. Then supporting element 28 is inserted into the ground 12 at the selected location by manually turning or twisting element 28 to drive the end having teeth 32 into the ground. In particular, the user will grasp both handle portions 36, 37 and exert downward and twisting or turning force on element 28. Earth or ground will be contained within the open interior of element 28 and it may be necessary to remove some of this material to provide easy insertion. Element 28 is inserted in the ground to the level of handle 34 and the upper end of element 28 thus is supported from the ground in a generally vertical position as shown in FIG. 5. Element 28 can be about 10 inches in overall length with the distance from teeth 32 to handle 34 being about 6 inches so that the portion extending up from the ground as shown in FIG. 5 is about 4 inches in length.

Figure 7:
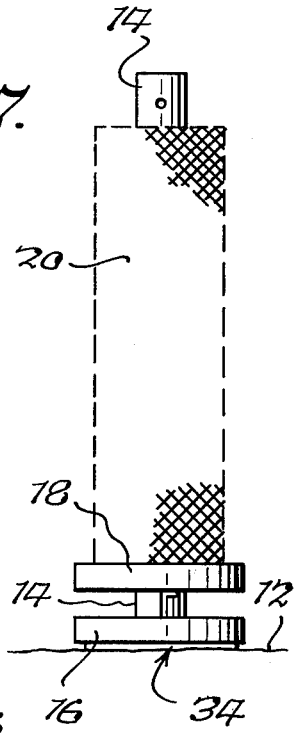
FIG. 7 is an elevational view showing the portable fence of the present invention at a further stage of installation.

The stakes 56 contained in tube 14 are removed and temporarily placed on the ground. Then guide element 16 is removed from the opposite end of post 14 simply by turning and then withdrawing slide bolt element 46 in a known manner so that the end thereof is disengaged from tube 14 whereupon disc 16 can be withdrawn from the end of tube 14. This can be facilitated by placing the portable fence assembly 10 in a vertical upright position resting on guide element 18 thereby making guide element 16 more easily accessible. Handle element 34 is rotated about central portion 38 so that the grip portions 36, 37 lie flat along the ground whereupon guide element 16 is placed over and onto the upwardly extending portion of support element 28 so that it rests on the ground as shown in FIG. 6. Then the portable fence assembly comprising tube 14, guide element 18 and fencing 20 is lifted and placed on the assembly of support element 28 and guide element 16 with the end of tubular post 14 containing guide element 18 fitted onto the upstanding end of support element 28 as shown in FIG. 7. The assembly is moved downwardly onto element 28 with the bottom end of post 14 fitting within the central aperture of guide element 16 and with guide element 18 resting on guide element 16. As a result, the assembly comprising post 14, guide element 18 and fencing 20 is rotatably supported on the assembly comprising guide element 16 and supporting element 28. Then fencing 20 is unwound from post 14 by releasing the hook fasteners 24 and by pulling rod 22, and the fencing is stretched out to the desired configuration and extent whereupon rods 56 are manually inserted into the ground at spaced locations for supporting the fence 20. Rods 56 are provided with hooks at the upper ends thereof to facilitate holding of fencing 20. The outer end of fencing 20 then can be secured to the end of the fencing attached to post 14 by the snap fasteners 24 to provide a complete enclosure as shown in FIG. 8.

Figure 8:
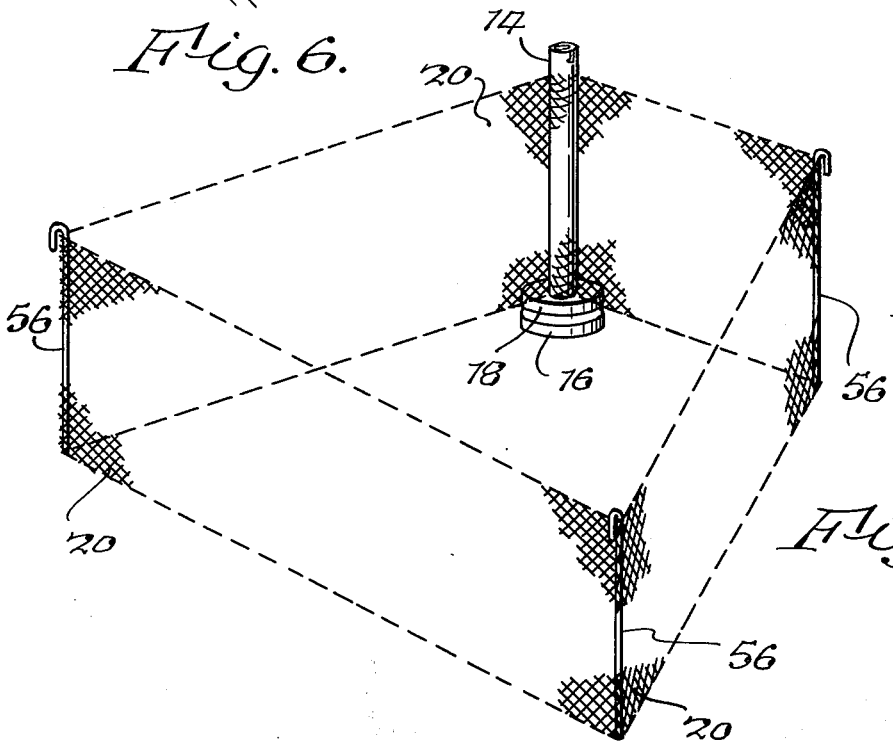
FIG. 8 is a perspective view showing the portable fence of the present invention installed in a position of use.
Figure 9:
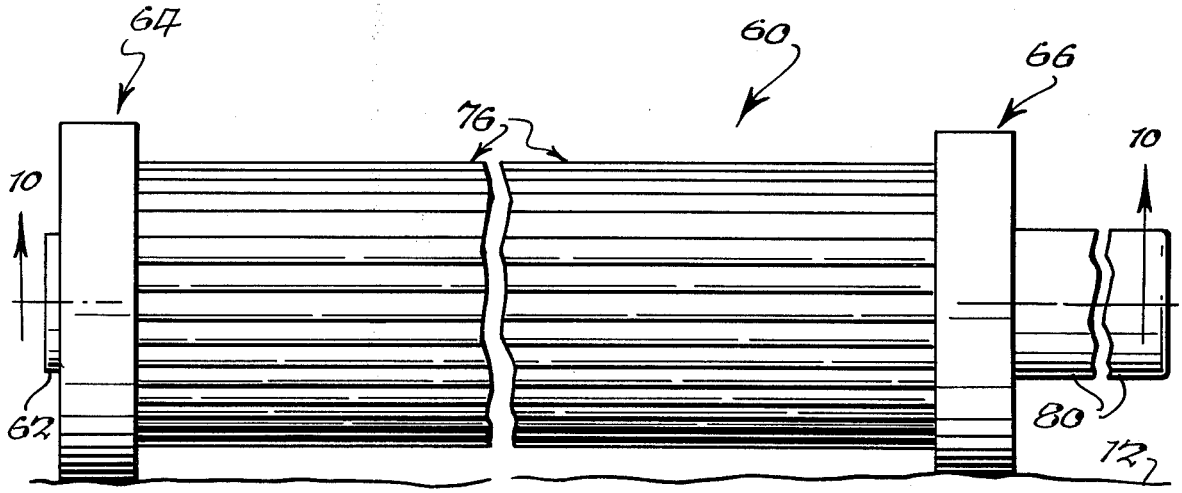
FIG. 9 is a side elevational view of a portable fence according to another embodiment of the present invention.

Fencing 20 illustrated in FIGS. 1 and 8 is of the commercially available open face type, i.e. of mesh like construction and preferably is of plastic material although it could be metal wire mesh. The flexible nature of the fencing material enables it to be placed in various configurations, for example triangular, rectangular, square, circular, and oval to mention a few.

The portable fence of the present invention in use thus closely resembles a standard permanent fence in appearance as is evident from the foregoing description and the illustration of FIG. 8. It is capable of many various uses such as enclosed a play area for children or a play area for pets, enclosing picnic and beach areas, enclosing wading pools, outdoor grills, garbage cans, excavations, or new cement work, enclosing gardens and newly planted grass and plants, and serving as a crowd guide. The portable fence of the present invention is quite useful and convenient for mobile homeowners. When the fencing 20 is in the form of a continuous solid sheet of material, i.e. closed face fencing, the portable fence is useful as a modesty guard, windbreaker or snow fence. The foregoing uses and applications of the portable fence of the present invention are illustrative but by no means exhaustive.

The portable fence 10 is easily dismantled from the installed condition of FIG. 8 to the condition of FIG. 1 for transportation and storage. Snap fasteners 24 are released and rods 56 removed from the ground and fencing 20 enabling the latter to be wound back on and around post 14 whereupon the end is secured by fasteners 24 as shown in FIG. 1. The assembly of post 14, fencing 20 and guide 18 is lifted from supporting element 28 and guide 16 and placed on the ground, and guide disc 16 is removed from element 28 and reconnected on the end of post 14, being locked thereon by means of slide bolt 46. Rods 56 are gathered and placed within post 14. Then handle 34 is grasped and element 28 is withdrawn from the ground and then inserted into the end of post 14, being locked therein by engagement of handle portion 38 in the bayonet slot arrangement. The portable fence 10 then is ready for transportation or carryung to a storage location.

The guide elements or discs 16, 18 on each end of the hollow tubular core 14 serve to contain the fencing 20 on the core, to form a base for upright storage, and to provide wheels to assist in rolling the fence to the point of use. The portable fence 10 of the present invention is of relatively compact construction and, for example, can have an overall length of about 36 inches with the diameters of discs 16, 18 being determined by the quantity of fencing 20 it is desired to contain.

FIGS. 9–14 illustrate a portable fence 60 according to another embodiment of the present invention. The portable fence 60 includes an elongated post element 62 in the form of a hollow tube similar to post element 14 of the previous embodiment. The portable fence also comprises a pair of guide elements 64, 66 adjacent opposite ends of the cylindrical post 62. In this embodiment each guide element is circular in shape having an inner hub portion and an outer annular rim portion, the two being joined by a base thereby defining an annular open region therebetween. In particular, guide element 64 has an inner circular hub portion 68 which fits onto the corresponding end of tube 62. Guide element 54 also has an outer, concentric rim portion 69, and the portions 68, 69 are joined by a base portion 70 to define an open annular region. Similarly, guide element 66 has an inner hub portion 71, an outer annular rim portion 72 and a base portion 73 joining the hub and rim portions, thereby defining an open annular region. Guide elements 64, 66 are of different outer diameters for a purpose which will be described.

A length of fencing 76 is secured at one end thereof by suitable means to post 62 and wound therearound in a position of storage between guide elements 64, 66 with the outer end fastened in place for storage in a manner similar to that of the previous embodiment. The fencing illustrated in FIGS. 9-14, however, is of the closed-face type and is of a sectional construction as will be described in detail presently. The portable fence 60 further comprises a supporting element 80 in the form of a hollow tube or sleeve closed at one end and open at the other with teeth or serrations 82 provided along the edge of the open end. Supporting element 80 is provided with a handle 84 having a central portion 85 connected therein and grip portions 86, 87 and this is similar to handle 34 of the previous embodiment. Guide element 66 is releasably fitted on support tube 62, being held thereon by means of handle 84. In particular, there is provided a bayonet slot arrangement in tube 62 and hub portion 71 of guide element 66 for locking engagement with handle 84. As shown in FIG. 12, a pair of axially extending, diametrically opposed slots 90, 91 are provided in tube 62 and a corresponding pair of slots 92, 93 are provided in hub portions 71 of guide element 62 in alignment with slots 90, 91. The axial slots communicate with corresponding circumferential slots of short length in a known manner. Guide element 64 is releasably connected on the opposite end of tube 62 by an element 95 which is inserted through slots provided in hub portion 68 of guide element 64 and the body of post 62. Element 95 as shown in FIG. 11 is generally triangular shaped and can serve as an implement for digging a hole in the ground to receive the end of supporting element 80 in a manner which will be described.

The portable fence 60 is carried to a desired location by means of handle 84 and in some instances can be rolled along the ground by means of the wheel-like guide elements 64, 66. Supporting element 80 is removed from the end of post element 62 by grasping handle portions 86, 87 and rotating elements 80 slightly within tube 62 to bring the central portion 85 of the handle in alignment with the slots whereupon supporting element 80 is axially withdrawn from the assembly. With element 80 removed, guide element 66 is withdrawn from the assembly and rods 96 are removed from the interior of tube 62 and temporarily placed on the ground. Guide element 66 is placed at the location where supporting element 80 is to be inserted with base 73 on the ground and with hub 71 and rim 72 extending upwardly so that the annular region therebetween is accessible. Implement 95 is withdrawn from the opposite end of the assembly and is used to remove earth from the region where element 80 is to be inserted which earth can be placed on the annular region of guide element 66 for concealment.

Supporting element 80 is inserted through hub 71 of guide element 66 and is driven into the ground in a manner similar to that of the previous embodiment to a point where handle portion 85 rests on the upper surface of base portion 73. Guide element 64 is removed from post 62 and placed onto element 66 in a nested relation as shown in FIG. 13, this being facilitated by having the inner diameter of rim 69 slightly larger than the outer diameter of rim 72. Then the assembly is placed in a vertical position and the end of tube 62 is fitted onto the upstanding portion of element 80 as shown in FIG. 13. Post element 62 is thus rotatably supported on element 80 in an upright position and fencing 76 can be unfastened at the outer end thereof and withdrawn to a desired configuration in a manner identical to that of the previous embodiment, with rods or stakes 95 being used to support the fence at spaced locations.

FIG. 14 shows a section of fencing 76 comprising one or more intermediate fencing elements 98, one interlocking or connecting element 100 extending from one end of element 98 axially thereaong, to about the center thereof whereupon it terminates in a prong or pin-like member 102 extending generally parallel to element 98, and another interlocking or connecting element 104 in the form of a hollow tube or sleeve on the opposite side of element 98 and extending from the opposite end thereof axially therealong inwardly to about the center. The fencing elements in the present illustration are cylindrical, preferably hollow tubular, and adjacent elements are joined in a suitable manner. Adjacent fencing sections are connected by engagement between the pin member 102 of one element and the sleeve 104 of the other section. As a result, a certain quantity or length of fencing 76 can be carried on the portable fence 60, but the length of the erected fencing can be adjusted as desired simply by removing or adding sections.

The fence is dismantled simply by removing stakes 96, winding fencing back around post element 62, withdrawing the assembly from the end of supporting element 80, withdrawing element 80 from the ground, removing the earth from the region of guide element 66 to the ground and replacing the guide elements 64, 66 in the positions shown in FIG. 10, and fastening the outer end of fencing 76. The portable fence 60 then can be conveniently transported and stored until future use is required.

The portable fence of the present invention is easily adaptable for use on hard surfaces incapable of penetration. For example this can be on hard indoor surfaces such as in gymnasiums and exhibition halls and on hard outdoor surfaces such as driveways and at sporting events, to mention a few. This is accomplished by having one or both of the guide elements weighted by an appropriate amount so that with the weighted element or elements at the lower end of the assembly in a position of use, the post element will be supported and maintained in an upright position. Preferably both of the guide elements will be weighted evenly to provide a balanced assembly. Thus, guide discs 16, 18 in the embodiment of FIGS. 1–8 would be made of a size and suitable material to have the desired weight. The guide elements 64, 66 in the embodiment of FIGS. 9–14 would be provided with weights in a suitable manner. The manner of erecting the portable fence would be similar to that described above with the exception that supporting elements 28 and 80 would not be used. In particular, guide element 16 of portable fence 10 would be removed from one end of the assembly, placed on the hard surface at a desired location, and then the portable fence assembly comprising tube 15, guide element 18 and fencing 20 is lifted and placed onto guide element 16 with the extending end of tube 14 being rotatably received in guide element 16. Either or both of guide elements 16, 18 are of sufficient weight to firmly support the assembly in a vertically upright position on the surface. The erection of fencing 20 and placement of stakes 56 is performed in the manner previously described, and the portable fence is readily dismantled and arranged for storage, transportation and reuse.

In a similar manner, guide elements 64, 66 of portable fence 60 would be removed from the assembly, placed in a nested or telescoping relation on the hard surface at the desired location, and then the portable fence assembly is lifted and placed onto guide elements 64, 66 with the end of post 62 being rotatably received therein. Either or both of guide elements 16, 18 are of sufficient weight to firmly support the assembly in a vertically upright position on the surface. The erection of fencing 76 and placement of stakes 96 is performed in the manner previously described, and the portable fence is readily dismantled and arranged for storage, transportation and reuse.

It is therefore apparent that the present invention accomplishes its intended objects. While several specific embodiments of the present invention have been described in detail, this is done for the purpose of illustration, not limitation.

I Claim:

1. A portable fence comprising:

a. storage means comprising a hollow elongated post element and a pair of guide elements connected to said post element at axially spaced locations thereon defining an open region between said guide elements in an axial direction and in all radial outward directions from said post element;

b. a length of flexible fencing fixed at one end to said post element and wound around said post between said guide elements so as to be stored thereon; and c. a supporting element removably carried by said storage means, said supporting element being elongated and adapted to be driven in the ground adjacent one end thereof and to be operatively connected to said storage means adjacent the other end thereof in a manner supporting said post element in a generally vertical position and permitting rotation of said post element relative to said supporting element whereby said fencing can be withdrawn from said storage means for placement in a position of use with said post element supporting said fencing adjacent one end thereof.

2. Apparatus according to claim 1, wherein one of said guide elements is releasably connected to said post and adapted to be connected to said post adjacent said other guide element whereby when said post is supported on said supporting element, said guide elements are adjacent the lower end thereof.

3. Apparatus according to claim 1, wherein said post element is in the form of a hollow tube and said supporting element comprises a sleeve removably fitting in one end of said tube.

4. Apparatus according to claim 3, wherein said supporting sleeve is provided with teeth on one end thereof, said end with said teeth being within said support tube when said supporting element is carried therein prior to use.

5. Apparatus according to claim 3, wherein said supporting sleeve has a portion extending axially beyond the end of said tube, said supporting sleeve having handle means on the extending portion thereof for manipulating said supporting sleeve, said handle means cooperating with means on said tube for releasably locking said supporting sleeve in said tube whereby said portable fence can be transported by holding said handle means.

6. Apparatus according to claim 1 further including an open region within said post element, means normally closing said region and permitting access thereto, and a plurality of fence supporting rods stored in said region.

7. Apparatus according to claim 1, wherein at least one of said guide elements is of circular shape having an inner hub portion and an outer annular rim portion spaced therefrom.

8. Apparatus according to claim 1, wherein said guide elements are of circular shape each having an inner hub portion and an outer annular rim portion spaced therefrom, the outer diameter of the rim of one element being slightly smaller than the inner diameter of the rim of the other element thereby permitting nesting of said elements.

9. Apparatus according to claim 1, wherein said fencing comprises a plurality of interlocking fencing sections.

10. Apparatus according to claim 1, wherein said storage means comprises a hollow tube with disc-shaped guide elements adjacent opposite ends of said tube, at least one of said discs being removable from said tube, and wherein said supporting element comprises a sleeve removably fitted into one end of said tube and having handle means thereon.

11. A portable fence comprising:

a. storage means comprising a hollow elongated post element and a pair of guide element connected to said post element at axially spaced locations thereon defining an open region between said guide elements in an axial direction and in all radial outward directions from said post element;

b. a length of flexible fencing fixed at one end to said post element and wound around said post between said guide elements so as to be stored thereon; and c. one of said guide elements being releasably connected to said post and adapted to be connected to said post adjacent said other guide element and at least one of said guide elements being weighted for supporting said post element in a generally vertical position with said guide elements adjacent the lower end thereof and resting on a supporting surface and permitting rotation of said post element relative to said guide elements whereby said fencing can be withdrawn from said storage means for placement in a position of use with said post element supporting said fencing adjacent one end thereof.

* * * * *